US010029287B2

(12) United States Patent
Au

(10) Patent No.: US 10,029,287 B2
(45) Date of Patent: Jul. 24, 2018

(54) CLEANING DEVICE FOR MICROWAVE OVEN

(71) Applicant: Wing Hang Au, Hong Kong (HK)

(72) Inventor: Wing Hang Au, Hong Kong (HK)

( * ) Notice: Subject to any disclaimer, the term of this patent is extended or adjusted under 35 U.S.C. 154(b) by 219 days.

(21) Appl. No.: 15/053,395

(22) Filed: Feb. 25, 2016

(65) Prior Publication Data

US 2017/0246666 A1 Aug. 31, 2017

(51) Int. Cl.

| | |
|---|---|
| ***B65D 8/02*** | (2006.01) |
| ***B08B 3/00*** | (2006.01) |
| ***B65D 25/28*** | (2006.01) |
| ***B65D 43/02*** | (2006.01) |
| ***H05B 6/64*** | (2006.01) |
| ***A47L 11/40*** | (2006.01) |
| ***F24C 14/00*** | (2006.01) |

(52) U.S. Cl.

CPC ..... *B08B 3/00* (2013.01); *A47L 11/4086* (2013.01); *B65D 11/08* (2013.01); *B65D 25/2811* (2013.01); *B65D 43/0225* (2013.01); *F24C 14/005* (2013.01); *H05B 6/6405* (2013.01); *H05B 6/6479* (2013.01)

(58) Field of Classification Search

CPC ..... B65D 11/08

See application file for complete search history.

(56) References Cited

U.S. PATENT DOCUMENTS 5,310,981 A * 5/1994 Sarnoff ..... A47J 27/088 126/369

* cited by examiner

*Primary Examiner* — Jason Ko

(74) *Attorney, Agent, or Firm* — Wayne & King LLC

(57) ABSTRACT

Provided are cleaning devices adapted for a microwave oven. A head cap of the cleaning device includes multiple through holes, and thus steam generated by heating a cleaning liquid can flow out of the through holes in a faster and more concentrated mode. Using the cleaning device of this disclosure, the cleaning operation for the microwave oven is more convenient, and safety hazard such as explosion or splashing is also prevented as well.

20 Claims, 9 Drawing Sheets

CLEANING DEVICE FOR MICROWAVE OVEN

TECHNICAL FIELD

This disclosure generally relates to a cleaning product, and particularly to a cleaning device adapted to melt off dirt and/or stain in a microwave oven.

BACKGROUND

Microwave oven cleaning is very common in people's daily life. Up to now, there are no specialized cleaning products adapted for the microwave oven, except pouring water and vinegar into a bowl or a container, however. Water and vinegar have been proven to be able to clean the microwave oven of their dirt and stain off effectively, while the sauces, for instance, are usually very hard to clean because they are not soft and melted. When using the bowl or the container for cleaning, they cannot cover the splash created while being heated up by the microwave oven (or radiation). The bowls and the containers do not have any handles; or even they have, the handle will be extremely hot after being heated. Besides, covering a lid or a seal thereon may have a chance of explosion. Therefore, there is great need to provide a cleaning device especially adapted for the microwave oven.

SUMMARY OF THIS DISCLOSURE

In one aspect, a cleaning device adapted for a microwave oven can be provided. The cleaning device can include a body part, a head cap and an intermediate part. The body part can be provided with an inner chamber for accommodating a cleaning liquid and a first opening communicating with the inner chamber. The head cap can surround the body part along a length direction of the body part, and the head cap can cover the first opening of the body part. A portion of the head cap, which portion corresponds to the first opening of the body part, can be provided with multiple through holes, where the first opening and the multiple through holes form a gas passage for venting steam of the cleaning liquid within the inner chamber. The intermediate part can also surround the body part, where the intermediate part can be located between the body part and the head cap in the length direction of the body part.

In another aspect, a cleaning device adapted for a microwave oven can also be provided, which can include a body part and a head cap connected with each other. The body part can be provided with an inner chamber for accommodating a cleaning liquid and a first opening communicating with the inner chamber. The head cap can cover the first opening of the body part when the two are connected together. A portion of the head cap, which portion corresponds to the first opening of the body part, can be provided with multiple through holes, where the first opening and the multiple through holes form a gas passage for venting steam of the cleaning liquid within the inner chamber.

In some embodiments, the body part can be provided with one or more handle(s) for gripping the cleaning device. The handle(s) may be made of non-heat material, such that it can maintain cool after being heated up in the microwave oven.

BRIEF DESCRIPTION OF THE DRAWINGS

Following detailed descriptions of respective embodiments in this disclosure can be understood better when combining with these figures, in which the same structure is represented by the same reference sign. In the figures.

DETAILED DESCRIPTION

A cleaning device adapted for a microwave oven is provided in various embodiments of this disclosure. A head cap of the cleaning device that covers a body part of the cleaning device can include multiple through holes. When using those cleaning devices, users may simply pour one or more cleaning liquid into the body part, and then screw to close the head cap which has lots of through holes for venting. This arrangement can not only prevent splash from creating mess, but more importantly, steam coining out from the through holes can be higher in speed and more concentrated. As compared with the cleaning method by virtue of a bowl or a container, the steam can move quicker, and hence it will be more effective. While the cleaning device is rotating during microwave oven's operation, the steam can cover a whole inner space of the microwave oven. The cleaning device of this disclosure is a splash proof and effective product for cleaning the microwave oven.

FIGS. 1-10 illustrate a cleaning device for cleaning a microwave oven in this disclosure. Below this cleaning device will be described in detail with reference to those figures.

Figure 1:
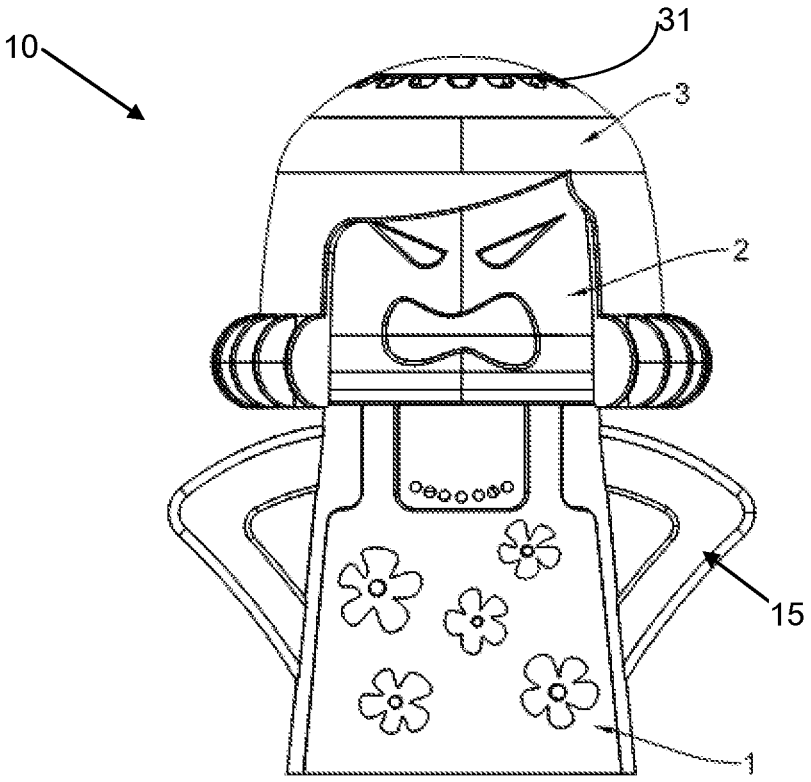
FIG. 1 is a front view for a cleaning device according to an embodiment of this disclosure.
Figure 2A:
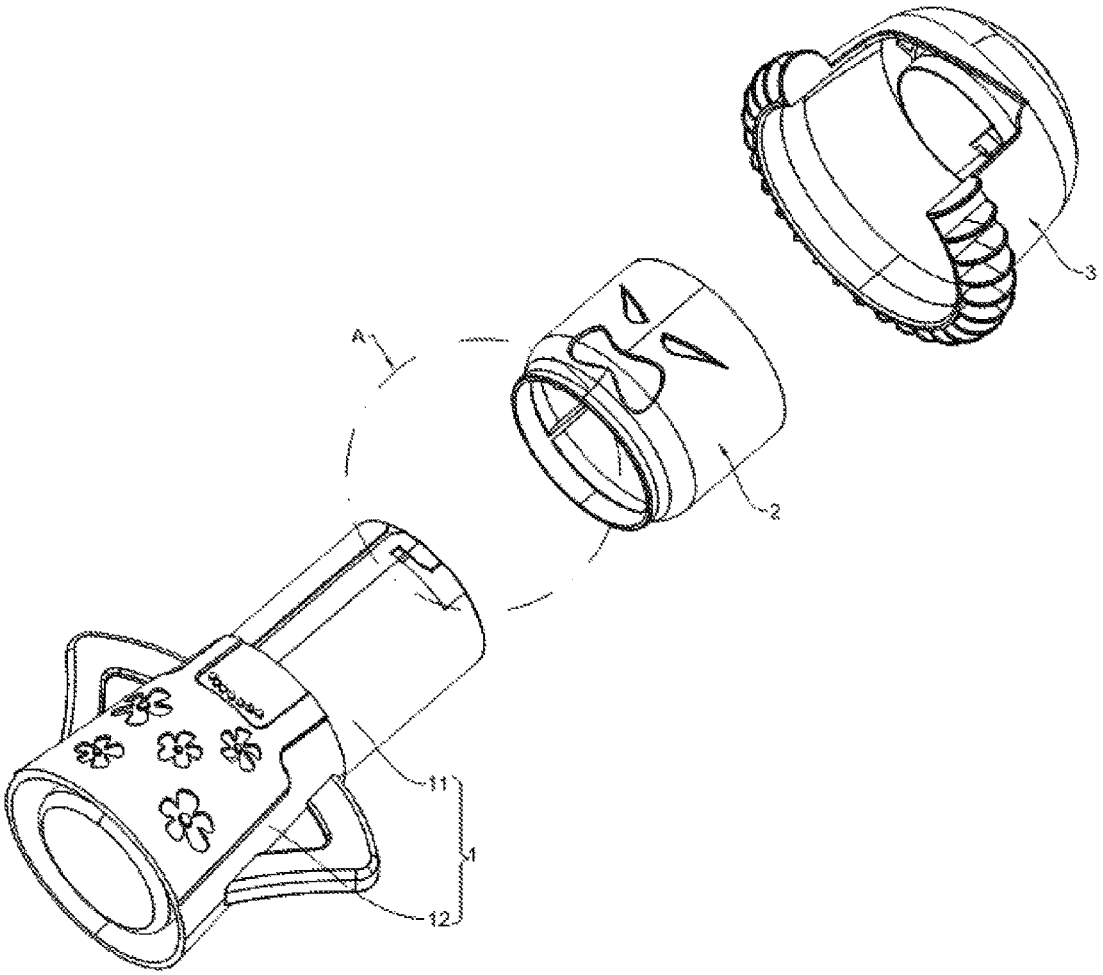
FIG. 2*a* is an exploded diagram for a cleaning device according to an embodiment of this disclosure.
Figure 2B:
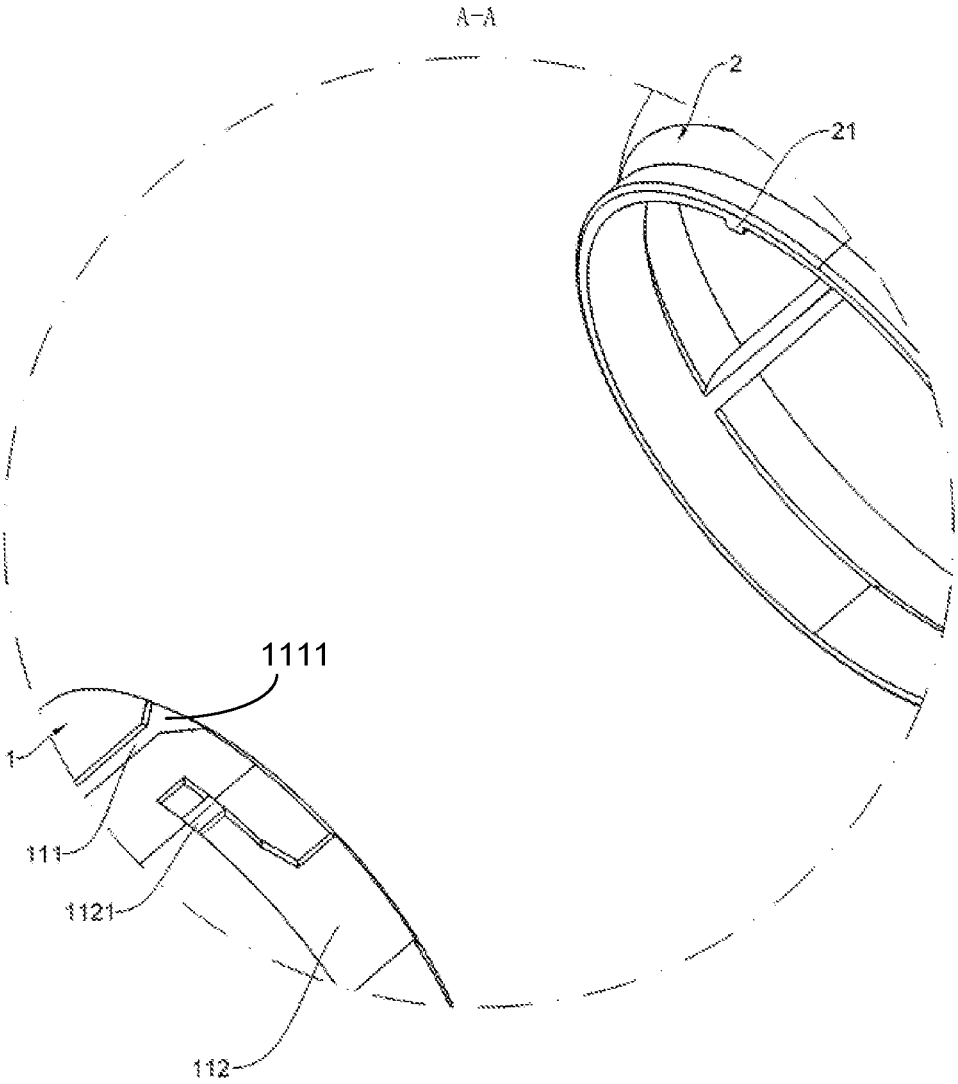
FIG. 2*b* is an enlarged diagram for a part A in FIG. 2*a;*
Figure 3:
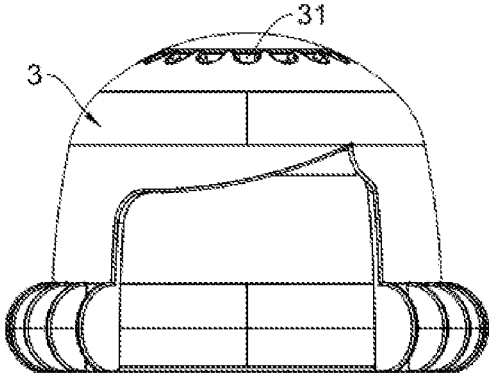
FIG. 3 is a partially exploded diagram for a cleaning device according to an embodiment of this disclosure.
Figure 3:
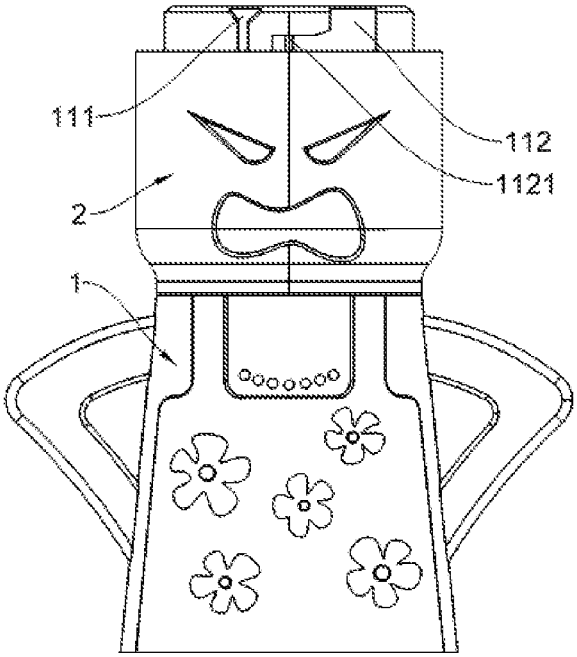
Figure 4:
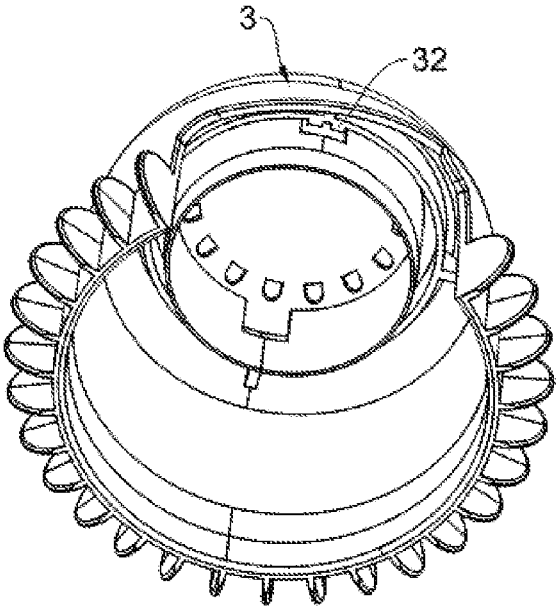
FIG. 4 is a schematic diagram for a head cap according to an embodiment of this disclosure.
Figure 5:
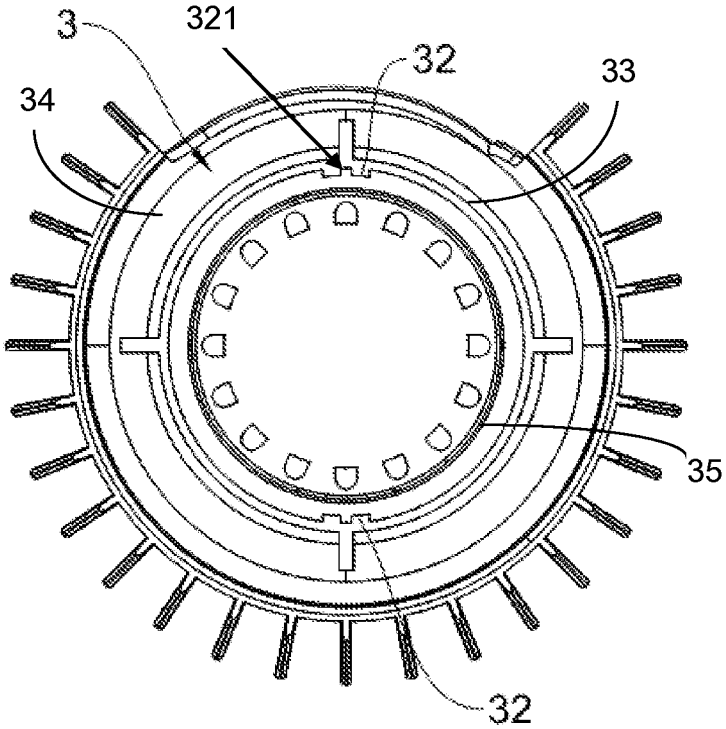
FIG. 5 is a bottom view for the head cap in FIG. 4.
Figure 6A:
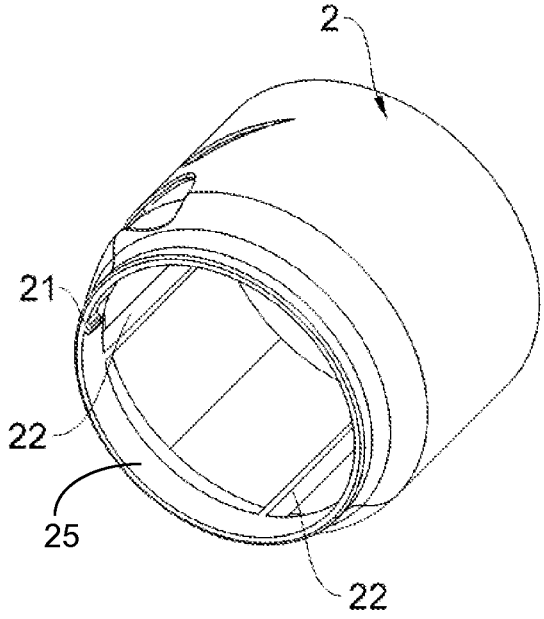
FIG. 6*a* is a schematic diagram for an intermediate part according to an embodiment of this disclosure.
Figure 6B:
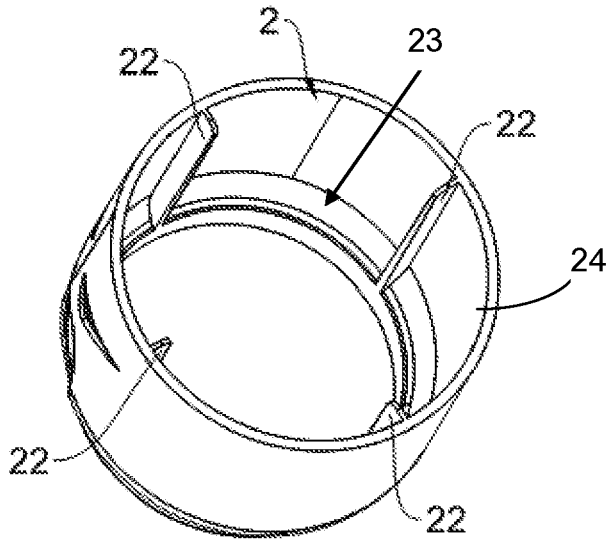
FIG. 6*b* is a schematic diagram for the intermediate part in FIG. 6 from another view.
Figure 7:
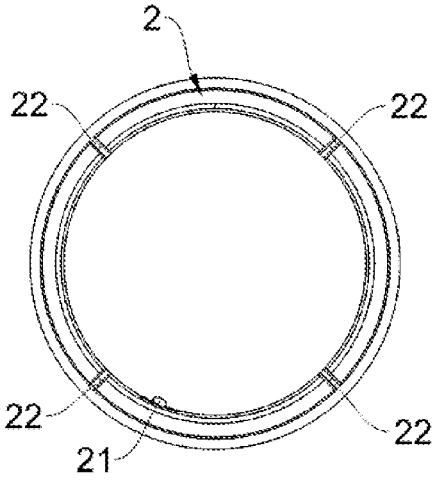
FIG. 7 is a top view for the intermediate part in FIG. 6.

FIG. 1 is a front view of a cleaning device according to a first embodiment of this disclosure. The cleaning device 10 can include a body part 1, an intermediate part 2 and a head cap 3. The body part 1 can be provided with an inner chamber 13 for accommodating a cleaning liquid and a first opening 14 communicating with the inner chamber 13. Both the head cap 3 and the intermediate part 2 can successively surround the body part 1 along a length direction of the body part 1, where the intermediate part 2 is located between the body part 1 and the head cap 3 in this length direction.

Here, the head cap 3 can cover the first opening 14 of the body part 1, such that the cleaning liquid will not splash during the heating process. Moreover, a portion of the head cap 3, which portion corresponds to the first opening 14 of the body part 1, can be provided with multiple through holes 31. In this case, the first opening 14 and the multiple through holes 31 can form a gas passage for venting steam generated by heating up the cleaning liquid within the inner chamber 13. According to this cleaning device, the steam vented from those through holes 31 can move quickly to cover the whole microwave oven, and also there will be no mess caused by the splashing of the cleaning liquid.

Preferably, the through holes 31 are in a shape of inverted cone. For this reason, the steam passing through those holes 31 can be sprayed in a faster way. It is mentioned that the cleaning liquid is not limited to be a solution formed by water and vinegar; alternatively, any other cleaning liquid, such as a solution formed by water and lemon juice (or lemon powder), can also be used as long as it can be heated to generate steams for cleaning the microwave oven.

In a further example, the body part 1 can be provided with one or more handle(s) 15 for gripping the cleaning device 10. The handle(s) 15 can be made of non-heat material, so that after the cleaning device 10 is heated during the cleaning process, the user can directly pick up the cleaning device 10 through the handle(s) 15 without any overheat experience. As shown in FIG. 1, two handles 15 are symmetrically arranged relative to a longitudinal axis of the body part 1.

The handle(s) can fixedly connect with the body part like that in FIG. 1. Alternatively, the handle(s) can be in removable connection with the body part, and it/they can be removed when the cleaning device is being heated within the microwave oven. As such, the removable handle(s) can be made of ordinary material without any material limitation. Specific structural configuration for removable connection between the handle and the body part will not limit the scope of this disclosure.

The head cap 3 and the intermediate part 2 are connected with the body part 1 in a removable way. Their detailed configurations are described in combination with FIGS. 2*a*-10 in this embodiment.

As shown in FIGS. 2*a*-3 and 6*a*-7, they illustrate the connection between the body part 1 and the intermediate part 2. The body part 1 can be a stepped structure consisted by an upper portion 11 and a lower portion 12, where a radial dimension of the lower portion 12 is larger than that of the upper portion 11, so as to form a step surface 121 at a joint between the upper portion 11 and the lower portion 12. The intermediate part 2 is a hollow cylinder with a respective opening at its upper end 24 and lower end 25. The intermediate part 2 surrounds the upper portion 11 of the body part 1, where its lower end 25 is rested against the step surface 121, and an edge of its upper end 24 is located lower than that of the upper portion 11. Under this configuration, the upper portion 11 can extend out of the upper opening of the intermediate part 2 so as to be secured with the head cap 3 as described below.

A first protrusion 21 (FIG. 6*a*) is arranged on an inner wall of the opening at the lower end 25 of the intermediate part 2, and a guiding slot 111 extending throughout the upper portion 11 along the length direction is disposed on the upper portion 11 of the body part 1. The guiding slot 111 can facilitate the assembling process due to its direction guiding function. The first protrusion 21 can slide along the guiding slot 111 during the assembling of the cleaning device 10. Further referring to FIG. 2*b*, the guiding slot 111 can include an enlarged opening 1111 for receiving the first protrusion 21 more conveniently. The first protrusion 21 can become accommodated within the enlarged opening 1111, and then start to slide along the remaining guiding slot 111.

Moreover, the intermediate part 2 is provided with multiple positioning bars 22 extending along the length direction, where the multiple positioning bars 22 can press against an outer surface of the body part 1 so as to position the intermediate part 2 on the body part 1 through contact friction. An annular flange 23 can further be arranged on the inner wall of the intermediate part 2 along a circumferential direction. The annular flange 23 can also press against the outer surface of the body part 1 so as to further enhance the positioning effect. In an example, one end of each positioning bar 22 is connected to the annular flange 23.

In some other embodiments, the body part 1 can also be divided into the upper portion and the lower portion, while there is no stepped design along its length direction. In this case, the intermediate part 2 can also be positioned with respect to the upper portion 11. For example, such positioning bars and annular flange can still secure the intermediate part 2 to the body part 1 in this case; or else, the intermediate part 2 can be screwed onto the upper portion 11 and so on.

As shown in FIGS. 4-5 and 8-9, they illustrate the connection between the body part 1 and the head cap 3. In order to secure the head cap 3, the upper portion 11 of the body part 1 includes a locking groove 112, and the head cap 3 includes a first annular wall 33 arranged with a second protrusion 32, where the second protrusion 32 is clamped within the locking groove 112 so as to connect the head cap 3 with the body part 1 together. There are two second protrusions 32 arranged oppositely to each other in FIG. 5, and correspondingly, two locking grooves 112 are respectively disposed on a front side and a back side of the upper portion 11. Those configurations can enhance the securing effect of the locking groove 112.

Figure 8:
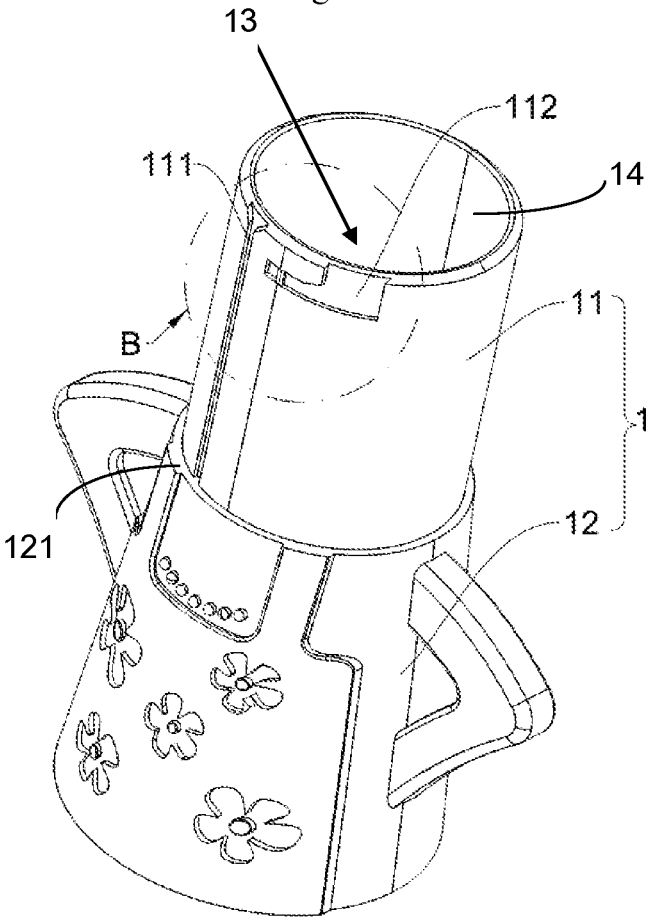
FIG. 8 is a schematic diagram for a body part with two handles according to an embodiment of this disclosure.
Figure 9:
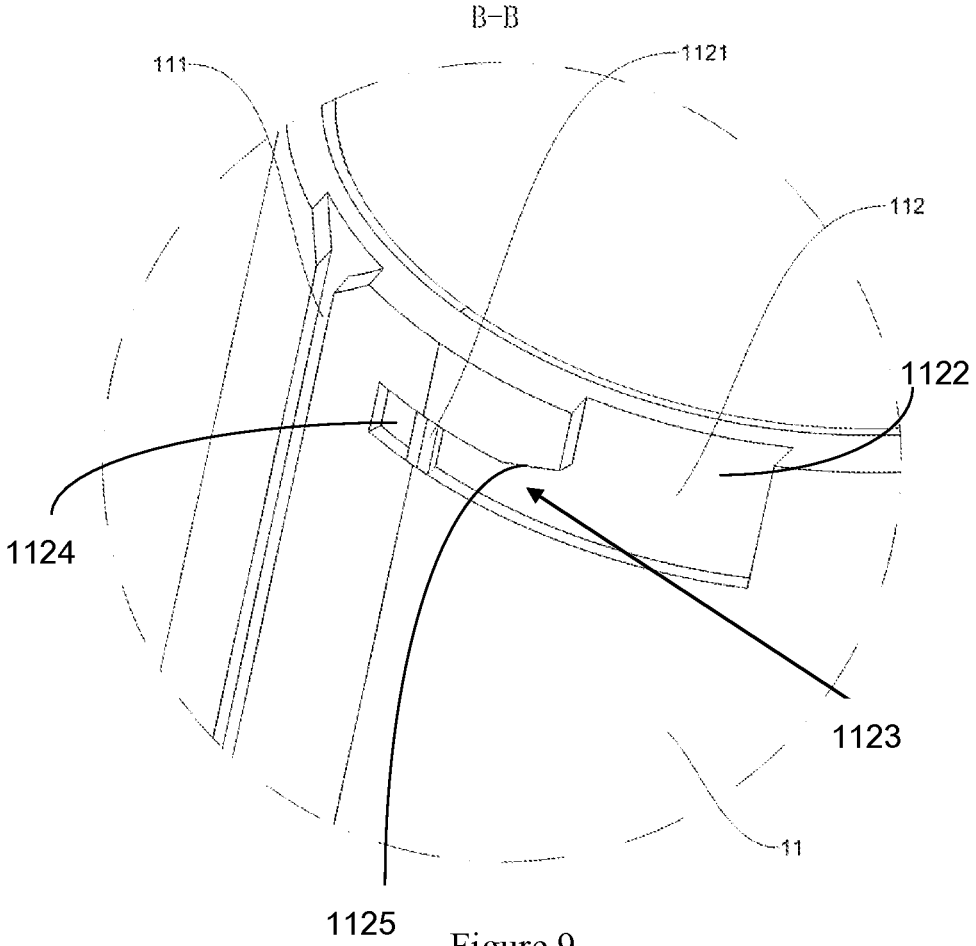
FIG. 9 is an enlarged diagram for a part B in FIG. 8.
Figure 10:
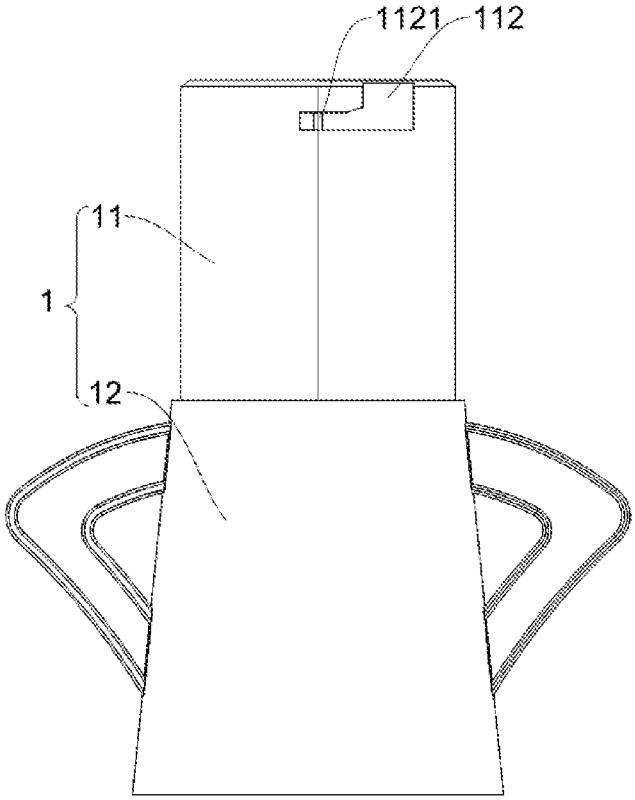
FIG. 10 is a back view for the body part in FIG. 8.

Further referring to FIGS. 8-9, the locking groove 112 includes a receiving part 1122, a guiding part 1123 and a locking part 1124, where the receiving part 1122 and the locking part 1124 communicate with each other through the guiding part 1123. The receiving part 1122 is provided with an enlarged opening, such that it is convenient to align the second protrusion 32 with the upper portion 11 during the assembling. There can also be a guiding surface 1125 arranged at the guiding part 1123. The guiding surface 1125 can be an inclined surface to achieve tapered dimension along its extending direction. When the second protrusion 32 slides into the locking part 1124 through the guiding part 1123, the second protrusion 32 becomes clamped due to the tapered dimension.

Also, a ridged structure 1121 is disposed within the locking part 1124 substantially perpendicularly to an extending direction of the locking part 1124. The second protrusion 32 is a protruding block with a recess 321 in its middle position. When the second protrusion 32 is clamped within the locking groove 112, the second protrusion 32 slides into the locking part 1124 with the recess 321 and the ridged structure 1121 to be engaged with each other. In this way, the head cap 3 and the body part 1 can be further secured together.

The head cap 3 further comprises a second annular wall 35 surrounded by the first annular wall 33. Both the first and the second annular walls 33 and 35 extend downwards from an internal top surface 34 of the head cap 3. The first annular wall 33 and the second annular wall 35 are concentrically arranged with respect to each other, while a gap is formed between the first annular wall 33 and the second annular wall 35. A longitudinal dimension of the first annular wall 33 is smaller than that of the second annular wall 35. Under this configuration, the second annular wall 35 is inserted into the body part 1 through the first opening 14 of the body part 1, and the first annular wall 33 partially surrounds the upper portion 11 of the body part 1 with its lower edge to be rested against the upper end 24 of the intermediate part 2.

In another embodiment, the second annular wall 35 is in interference fit with the inner wall of the body part 1 after the second annular wall 35 is inserted into the body part 1. Specifically, at least two open slots are arranged on the second annular wall 35. During the assembling, the second annular wall 35 can be deformed to be inserted into the body part 1 due to the existence of the open slots, and a restoring force is generated to overcome the deformation so that the second annular wall 35 is pressed onto the body part 1.

In some other embodiments, a sealing ring is further provided on an end face of the upper portion 11 so as to form a gas-tight connection between the body part 1 and the head cap 3. By virtue of the gas-tight connection, the steam can be better guided to be vented from the through holes 31.

The body part 1 described above can also be at least partially translucent or transparent. As such, the user can determine whether the cleaning liquid has been used up without disassembling the head cap 3 from the body part 1.

Although specific structures are described above, it should be noted that this disclosure is not limited to those descriptions, while any other modifications or changes can occur to the person skilled in the art without departing from the spirit of this disclosure.

According to another embodiment of this disclosure, the intermediate part can be removed, and thus a cleaning device here can include the body part and the head cap connected with each other. The body part can be provided with an inner chamber for accommodating a cleaning liquid and a first opening communicating with the inner chamber. The head cap can cover the first opening of the body part when the two are connected together. A portion of the head cap, which portion corresponds to the first opening of the body part, can be provided with multiple through holes, where the first opening and the multiple through holes form a gas passage for venting steam of the cleaning liquid within the inner chamber. The multiple through holes can be in a shape of an inverted cone to improve the venting effect. The body part is provided with one or more handle(s) for gripping the cleaning device, where the handle(s) is/are made of non-heat material. The head cap can be connected with the body part in the same way as in the first embodiment, which will not be repeated here.

The head cap includes a first annular wall and a second annular wall that respectively extend downwards from the internal top surface of the head cap. The first annular wall and the second annular wall are concentrically arranged with respect to each other, and a longitudinal dimension of the first annular wall is smaller than that of the second annular wall. The first annular wall surrounds a portion of the body part, and a gap is formed between the first and the second annular walls. The second annular wall is inserted into the body part through the first opening of the body part, the first annular wall partially surrounds the upper portion, and the upper portion is located within the gap between the first and the second annular walls. A sealing ring is further provided at an end face of the upper portion so as to form a sealing arrangement between the body part and the head cap. In this case, the steam can be better guided to be vented from the through holes.

The cleaning devices in various embodiments of this disclosure cater for cleaning usage. It takes into consideration of liquid heated up in the microwave oven and addresses all problems including splashing or explosion that may possibly happen. By usage of the cleaning devices above, a better and more convenient cleaning operation can be achieved aiming at the microwave oven.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Many other changes and modifications may be made to this disclosure without departing from the spirit thereof. The scope of these and other changes will become apparent from the appended claims.

The invention claimed is:

1. A cleaning device adapted for microwave oven, comprising:

a body part that is provided with an inner chamber for accommodating a cleaning liquid and a first opening communicating with the inner chamber;

an intermediate part surrounding at least a portion of the body part along a length direction of the body part, and a head cap that surrounds the intermediate part along the length direction of the body part and covers the first opening of the body part; a portion of the head cap, which portion corresponds to the first opening of the body part, is provided with multiple through holes, wherein the first opening and the multiple through holes form a gas passage for venting steam of the cleaning liquid within the inner chamber.

2. The cleaning device of claim 1, wherein the body part is provided with one or more handle(s) for gripping the cleaning device; the handle(s) is/are made of a material that maintains cool after being heated.

3. The cleaning device of claim 2, wherein there are two said handles which are symmetrically arranged relative to a longitudinal axis of the body part.

4. The cleaning device of claim 1, wherein the body part is provided with one or more handle(s) for gripping the cleaning device; the handle(s) is/are in removable connection with the body part so as to be removed when the cleaning device is being heated within the microwave oven.

5. The cleaning device of claim 1, wherein the body part is a stepped structure consisted by an upper portion and a lower portion, and a radial dimension of the lower portion is larger than that of the upper portion, so as to form a step surface at a joint between the upper portion and the lower portion;

the intermediate part is a hollow cylinder with a respective opening at its upper end and lower end; wherein the intermediate part surrounds the upper portion of the body part with its lower end to be rested against the step surface, and with an edge of its upper end to be lower than that of the upper portion.

6. The cleaning device of claim 5, wherein a first protrusion is arranged on an inner wall at the lower end of the intermediate part, and a guiding slot extending throughout the upper portion along the length direction is disposed on the upper portion of the body part; the first protrusion can slide along the guiding slot.

7. The cleaning device of claim 1, wherein the intermediate part is provided with multiple positioning bars extending along the length direction, the multiple positioning bars press against an outer surface of the body part.

8. The cleaning device of claim 7, wherein the intermediate part further comprises an annular flange arranged on its inner wall along a circumferential direction; the annular flange also presses against the outer surface of the body part, and one end of each positioning bar is connected to the annular flange.

9. The cleaning device of claim 1, wherein each of the multiple through holes is in a shape of an inverted cone that comprises a first end away from the first opening and a second end close to the first opening, wherein the size of the first end is larger than that of the second end.

10. The cleaning device of claim 1, wherein the body part comprises an upper portion arranged with a locking groove, and the head cap comprises a first annular wall that surrounds the upper portion by extending downwards from an internal top surface of the head cap; the first annular wall is arranged with a second protrusion, wherein the second protrusion is clamped within the locking groove so as to connect the head cap with the body part together.

11. The cleaning device of claim 10, wherein the locking groove comprises a receiving part, a guiding part and a locking part, and the receiving part and the locking part communicate with each other through the guiding part; a ridged structure is disposed within the locking part substantially perpendicularly to an extending direction of the locking part;

the second protrusion is a protruding block with a recess; when the second protrusion is clamped within the locking groove, the second protrusion slides into the locking part through the guiding part with the recess and the ridged structure to be engaged with each other.

12. The cleaning device of claim 10, wherein the head cap further comprises a second annular wall that extends downwards from the internal top surface of the head cap; the first annular wall and the second annular wall are concentrically arranged with respect to each other, and a longitudinal dimension of the first annular wall is smaller than that of the second annular wall; the second annular wall is inserted into the body part through the first opening of the body part.

13. The cleaning device of claim 12, wherein the second annular wall is in interference fit with an inner wall of the body part after the second annular wall is inserted into the body part.

14. The cleaning device of claim 12, wherein a sealing ring is further provided on an end face of the upper portion so as to form a gas-tight connection between the body part and the head cap.

15. The cleaning device of claim 1, wherein the body part is at least partially translucent or transparent.

16. A cleaning device adapted for microwave oven, comprising:

a body part that is provided with an inner chamber for accommodating a cleaning liquid and a first opening communicating with the inner chamber; and a head cap that connects with the body part and covers the first opening of the body part; a portion of the head cap, which portion corresponds to the first opening of the body part, is provided with multiple through holes, wherein the first opening and the multiple through holes form a gas passage for venting steam of the cleaning liquid within the inner chamber;

wherein the body part comprises an upper portion arranged with a locking groove, and the head cap comprises a first annular wall that surrounds the upper portion by extending downwards from an internal top surface of the head cap; the first annular wall is arranged with a second protrusion, wherein the second protrusion is clamped within the locking groove so as to connect the head cap with the body part together;

the locking groove comprises a receiving part, a guiding part and a locking part, and the receiving part and the locking part communicate with each other through the guiding part; a ridged structure is disposed within the locking part substantially perpendicularly to an extending direction of the locking part;

the second protrusion is a protruding block with a recess; when the second protrusion is clamped within the locking groove, the second protrusion slides into the locking part through the guiding part with the recess and the ridged structure to be engaged with each other.

17. The cleaning device of claim 16, wherein the body part is provided with one or more handle(s) for gripping the cleaning device; the handle(s) is/are made of a material that maintains cool after being heated.

18. The cleaning device of claim 16, wherein the head cap comprises a first annular wall and a second annular wall that respectively extend downwards from an internal top surface of the head cap; the first annular wall and the second annular wall are concentrically arranged with respect to each other, and a longitudinal dimension of the first annular wall is smaller than that of the second annular wall; the first annular wall surrounds a portion of the body part, and the second annular wall is inserted into the body part through the opening of the body part.

19. The cleaning device of claim 18, wherein an upper portion of the body part is partially located between the first annular wall and the second annular wall; a sealing ring is provided at an end face of the upper portion so as to form a sealing arrangement between the body part and the head cap.

20. The cleaning device of claim 16, wherein each of the multiple through holes is in a shape of an inverted cone that comprises a first end away from the first opening and a second end close to the first opening, wherein the size of the first end is larger than that of the second end.

* * * * *